US005983486A

United States Patent [19]

Shimomura et al.

[11] Patent Number: 5,983,486

[45] **Date of Patent: *Nov. 16, 1999**

[54] PROCESS FOR PRODUCING INK JET HEAD

[75] Inventors: Akihiko Shimomura, Yokohama; Shoji Shiba, Sagamihara; Isao Imamura; Kenji Aono, both of Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/612,422

[22] Filed: Mar. 7, 1996

[30] Foreign Application Priority Data

Mar. 10, 1995 [JP] Japan ..... 7-051079
Jul. 7, 1995 [JP] Japan ..... 7-171979

[51] Int. Cl.[6] ..... H05B 3/00

[52] U.S. Cl. ..... 29/611; 29/890.1

[58] Field of Search ..... 29/890.1, 592.1, 29/25.35, 424, 611; 264/317

[56] References Cited

U.S. PATENT DOCUMENTS

| | | | |
|---|---|---|---|
| 5,334,999 | 8/1994 | Kashiwazaki et al. | 29/890.1 |
| 5,443,942 | 8/1995 | Imamura | 430/329 |
| 5,478,606 | 12/1995 | Ohkuma et al. | 427/555 |

FOREIGN PATENT DOCUMENTS

| | | |
|---|---|---|
| 0-488675 | 11/1991 | European Pat. Off. . |
| 0-609860 | 2/1994 | European Pat. Off. . |
| 8169114 | 7/1996 | Japan . |

OTHER PUBLICATIONS

Patent Abstracts of Japan, "Ink Jet Recording Head, Manufacture thereof And Recorder With The Recording Head", Jun. 27, 1995, Abstract.

*Primary Examiner*—Carl E. Hall
*Attorney, Agent, or Firm*—Fitzpatrick, Cella Harper & Scinto

[57] ABSTRACT

A process for producing an ink jet head comprising a liquid-discharge energy generating element for discharging a liquid, a discharge opening, a liquid-flow path, and a substrate for holding the liquid-discharge energy generating element, the process comprises the steps of: preparing the substrate; providing on the substrate the liquid-discharge energy generating element; providing a solid layer with a convex shape on the surface of the substrate where the liquid-discharge energy generating element has been provided and at the part where the liquid-flow path and the discharge opening are to be provided, the solid layer being formed of a resin capable of being dissolved away; applying on the substrate provided with the solid layer a curable material in a thickness larger than the thickness of the solid layer, to cover the solid layer; curing the curable material; evenly removing the cured material until the convex portion of the solid layer is laid bare; and dissolving away the solid layer to form the liquid-flow path and the discharge opening.

6 Claims, 5 Drawing Sheets

PROCESS FOR PRODUCING INK JET HEAD

BACKGROUND OF THE INVENTION

1. Field of the Invention

This invention relates to a process for producing an ink jet head for discharging printing droplets in ink jet printing systems.

2. Related Background Art

Ink jet heads used in ink jet printing systems are commonly provided with fine discharge openings from which printing droplets are discharged, liquid-flow paths, and liquid-discharge energy generating portions. When viewed from the positional relationship between the liquid-discharge energy generating portion and the discharge opening, such ink jet heads are roughly grouped into two forms, one of which is what is called an edge shooter type ink jet head, where the direction of growth of bubbles and the direction of discharge thereof are different, and the other of which is what is called a side shooter type ink jet head, where the direction of growth of bubbles and the direction of discharge thereof are substantially the same. Of these two forms, the side shooter type ink jet head is commonly constructed as shown in FIGS. 8A and 8B.

In FIGS. 8A and 8B, reference numeral 1 denotes a substrate. On this substrate 1, a liquid-discharge energy generating element 2 is provided. Reference numeral 3*a* denotes a discharge opening from which printing droplets are discharged. In the construction shown in the drawing, two discharge openings are formed, which are provided above two liquid-discharge energy generating elements 2. Thus, in this head, the direction of growth of bubbles and the direction of discharge thereof are substantially the same. The discharge openings 3*a* are provided in a discharge opening plate 5H, and the discharge opening plate 5H is joined to the substrate 1 via liquid-flow path walls 3H that form a liquid-flow path 3*b* communicating with the discharge openings.

As a process for producing such a side shooter type ink jet head, for example, a process is known in which a negative type photosensitive dry film is stuck to a substrate provided with the liquid-discharge energy generating element, and the photosensitive dry film is masked in a pattern corresponding to a liquid-flow path and a liquid chamber, which is then exposed to light, followed by development to form the liquid-flow path wall, and next a discharge opening plate 5H produced by electroforming of Ni or the like, provided with the discharge openings, is joined to the substrate via the flow path wall. In this process, however, precise alignment must be made between discharge openings of the discharge opening plate and discharge energy generating elements, and hence a large-sized apparatus for improving assemblage precision is necessary, also requiring complicated production steps. Thus, this process is not so much suited for the bulk production of ink jet heads at a low cost.

Under such circumstances, U.S. Pat. No. 5,478,606 discloses a process in which a soluble resin is used to form a liquid-flow path pattern on a substrate provided with liquid-discharge energy generating elements, then a coating resin layer which is to serve as ink-flow path walls and a discharge opening plate is formed by spin coating, thereafter the coating resin layer is cured and at the same time discharge openings are formed, and finally the pattern is dissolved away. In this process, the discharge openings are formed by photolithography or oxygen plasma etching or using an excimer laser after the coating resin layer has been formed, and hence it is unnecessary to make precise alignment to join the discharge opening plate to the substrate. However, even this process has been sought to be further improved in view of material selectivity and improvement in productivity. More specifically, when photolithography is used to form the discharge opening in the coating resin layer, the coating resin must be a photosensitive resin. Also, when the discharge openings are formed by oxygen plasma etching, it is not only necessary to add the steps of forming and removing a resist mask for the oxygen plasma etching, but also necessary to make treatment for a long time using an expensive apparatus for the dry etching. Also when the discharge openings are formed using the excimer laser, not only it is necessary to use a large-sized expensive apparatus as in the oxygen plasma etching, but also there is a possibility that the discharge openings are reverse-tapered in shape in the direction of discharge.

SUMMARY OF THE INVENTION

The present invention was made taking account of the problems discussed above, and an object thereof is to provide a process for producing an ink jet head, that can achieve inexpensive bulk production of ink jet heads.

Another object of the present invention is to provide a process for producing an ink jet head, that can achieve a broad material selectivity for flow path wall materials and promise a superior productivity.

As constitution that achieves the above objects, the present inventors proposes a process for producing an ink jet head comprising an liquid-discharge energy generating element for discharging a liquid, a discharge opening provided above the liquid-discharge energy generating element and from which the liquid is discharged, a liquid-flow path communicating with the discharge opening and inside provided with the liquid-discharge energy generating element, and a substrate for holding the liquid-discharge energy generating element, the process comprising the steps of:

preparing the substrate;

providing on the substrate the liquid-discharge energy generating element;

providing a solid layer with a convex shape on the surface of the substrate where the liquid-discharge energy generating element has been provided and at the part where the liquid-flow path and the discharge opening are to be provided, the solid layer being formed of a resin capable of being dissolved away;

applying on the substrate provided with the solid layer a curable material in a thickness larger than the thickness of the solid layer, to cover the solid layer;

curing the curable material;

evenly removing the cured material until the convex portion of the solid layer is laid bare; and dissolving away the solid layer to form the liquid-flow path and discharge opening.

According to the ink jet head production process of the present invention, the products can be obtained through simple steps, in a shorter time and through a smaller number of steps. Hence, the process has the effect of achieving a superior bulk productivity and also reducing the cost of products.

DESCRIPTION OF THE PREFERRED EMBODIMENTS

Embodiments in working the present invention will be described below with reference to the accompanying drawings.

Figure 1A:
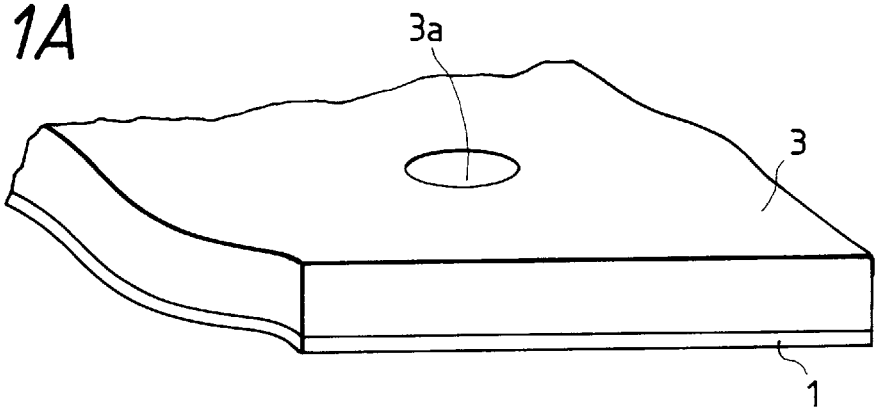
FIGS. 1A and 1B illustrate an example of the construction of an ink jet head produced in Example 1 of the present invention.
Figure 1B:
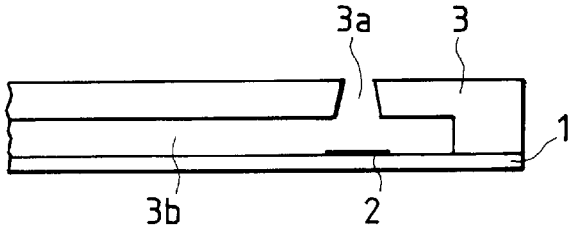

FIGS. 1A and 1B illustrate an example of the constitution of the ink jet head according to the present invention, FIG. 1A being a perspective view of its main part, and FIG. 1B its cross-sectional view.

On a substrate 1, a liquid-discharge energy generating element 2 is provided. In a coating resin layer 3 serving as a liquid-flow path wall, a discharge opening 3*a* and a liquid-flow path 3*b* are formed. As the substrate 1, any known substrates such as a silicon wafer may be used. As the liquid-discharge energy generating element 2, any known elements such as an electrothermal transducer may be used.

The ink jet head production process of the present invention will be described below reffering to FIGS. 2A to 2C.

First, on the substrate 1 made of the above material, an element-positioning-face 1*a* is formed which is provided with an electrothermal transducer as the liquid-discharge energy generating element. The electrothermal transducer is formed on the substrate by a semiconductor process such as vapor deposition, sputtering or etching.

Next, on the element-positioning-face 1*a*, a solid layer 4 having a liquid-flow path pattern designed for a liquid-flow path and a liquid chamber is formed at the part corresponding to the electrothermal transducer. The solid layer 4 may be formed using a high-precision plating positive type resist or the like.

In the solid layer 4, a convex portion 4*a* corresponding to a discharge opening is prepared, which can be prepared by subjecting the positive type resist to exposure and development each twice. The solid layer having been thus formed is as perspectively shown in FIG. 2C.

A patterning process to form this solid layer will be detailed below.

Figure 2A:
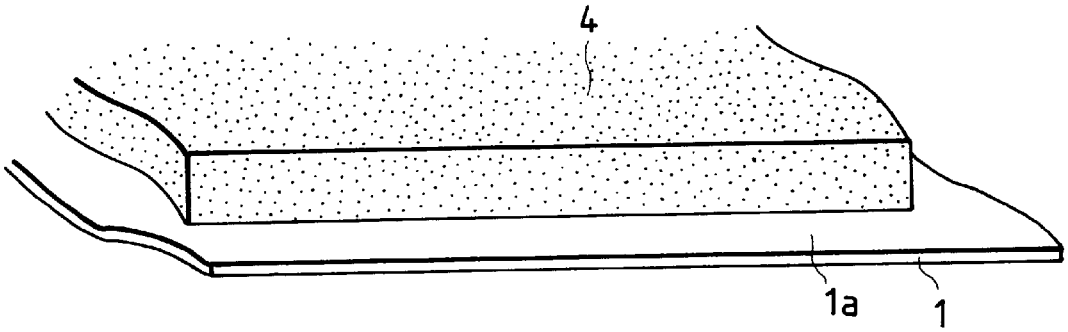
FIGS. 2A to 2C illustrate a process of forming the solid layer in the present invention.
Figure 2B:
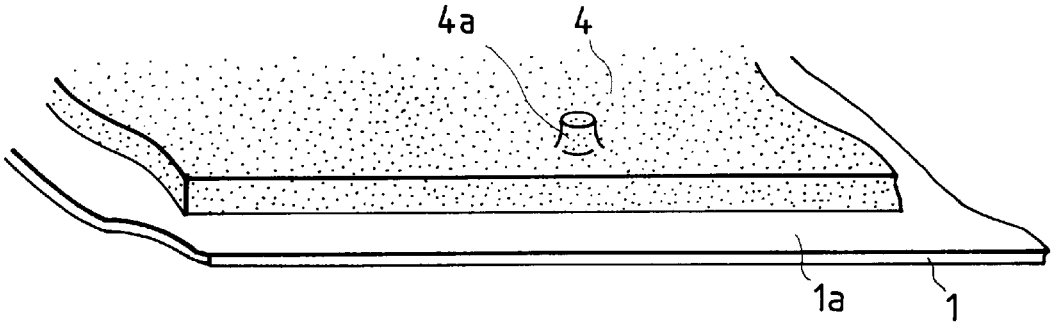
Figure 2C:
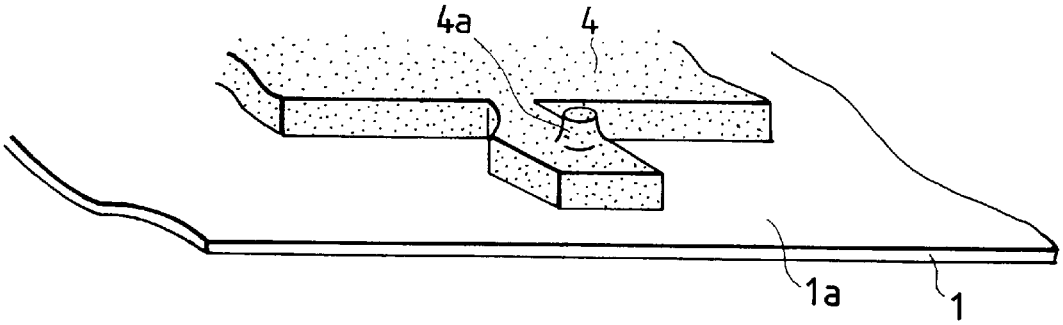

Hitherto, when a convex portion is provided in the solid layer as shown in FIG. 2C, the solid layer has been formed in double-layer structure by separate patterning means. In the present invention, the solid layer is made to have a layer thickness large enough to enable the formation of discharge openings at one time, where, while adjusting exposure dose, the latent image is withheld at a desired thickness so that the second-time exposure pattern can be within the area of the first-time exposure pattern and also be different from the first-time exposure pattern. This makes it possible to simplify the steps and form the discharge opening pattern in a good precision.

FIGS. 2A to 2C illustrate a process of forming the solid layer in the present invention.

First, on the element-positioning-face 1*a* of the substrate 1, a positive type resist 4 for forming the solid layer is provided. Here, the positive type resist 4 is set in a thickness equal to a predetermined distance from the electrothermal transducer to the discharge opening (FIG. 2A).

Subsequently, the positive type resist 4 is subjected to first exposure in the manner that its part corresponding to the discharge opening remains, followed by development to form the convex portion 4*a* which is to form the discharge opening (FIG. 2B). In this exposure, the exposure dose is set a little lower than usual so that the latent image can be withheld at the desired thickness.

Next, the positive type resist 4 is subjected to second exposure within the area of the first exposure and in the manner that its part corresponding to the liquid-flow path remains, followed by development to form the solid layer 4 (FIG. 2C).

Thereafter, the solid layer 4 is optionally subjected to whole area exposure, deaeration or the like.

Figure 3A:
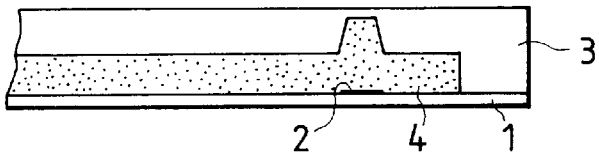
FIGS. 3A to 3C illustrate a process of producing the ink jet head of Example 1 of the present invention.
Figure 3B:
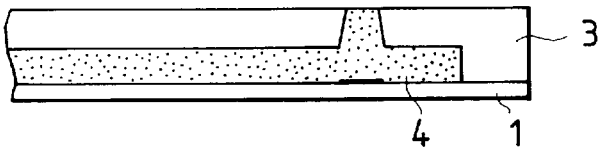
Figure 3C:
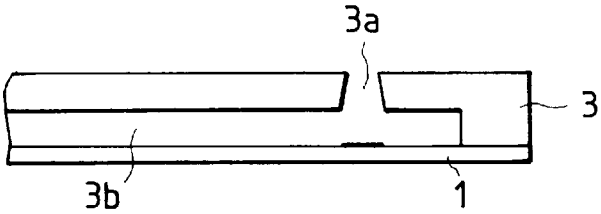

Next, the resulting substrate 1 is put on a spin coater to coat a curable material 3 which is to form a coating resin layer (FIG. 3A). Here, the curable material is coated in a thickness larger than the layer thickness of the solid layer 4. Subsequently, the curable material 3 is cured, and then the cured material is evenly removed by a method such as polishing or etching until the top of the convex portion of the solid layer is laid bare to the surface (FIG. 3B). Finally, the solid layer 4 is dissolved away, and thus the ink jet head is completed (FIG. 3C).

As methods for removing the solid layer 4, for example, a method is available in which the layer is dissolved away using an aqueous sodium hydroxide solution in the case where the solid layer 4 is formed of a positive type resist, or using a solution of an organic solvent such as acetone in the case where the solid layer 4 is formed of a high-precision plating positive type resist. Solutions therefor are by no means limited to the foregoing so long as they do not attack the curable material. Needless to say, the solid layer 4 can be more effectively removed when an accelerating means such as solvent agitation or ultrasonic waves is/are used in combination.

In the present production process, the curable material is coated in a little larger thickness and thereafter the cured material is evenly removed to have a predetermined thickness, and hence the discharge opening can have a smooth face, bringing about the advantage that the ink may hardly stand there.

When polished, the solid layer 4 is inside the liquid-flow path 3*b* playing an important role in the ink jet head. This is preferable because of the advantage that the problem of ink flow path clogging due to cuttings, dust and so forth can be solved.

In practice, the ink jet head is subsequently subjected to various steps such as washing and surface treatment and is fitted with auxiliary parts such as a filter to make up a final product. These have no direct relation to the object of the present invention, and the description thereon is omitted.

The present invention will be described below in greater detail by giving Examples.

EXAMPLE 1

On a silicon substrate on which electrothermal transducers had been formed as liquid-discharge energy generating elements, a positive type photoresist AZ-4903 (trade name; available from Hoechst Japan Ltd.) was spin coated so as to be in a layer thickness of 50 $\mu$m, followed by pre-baking in an oven at 90° C. for 40 minutes to form a resist layer.

To the surface of the resist layer thus formed, patternwise exposure was applied at a proper exposure dose using a mask aligner (PLA-501, trade name; available from Canon Inc.) via a mask pattern corresponding to nozzles and liquid chambers, followed by development by the use of an aqueous solution of 0.75% by weight of sodium hydroxide. This step was carried out using two kinds of masks and two kinds of exposure dose to form a resist pattern with a convex shape. Subsequently, this was rinsed with ion-exchanged water, followed by post-baking at 70° C. for 30 minutes to obtain a resist pattern.

Next, the resist pattern was subjected to whole area exposure, and thereafter the following curable material was coated on the resist pattern by means of a spin coater. The spin coating was stepwise carried out under conditions of 450 rpm for 20 seconds plus 1,500 rpm for 1 second.

As a curable resin, an epoxy resin composition as shown below was used.

Main Components:

Epoxy resin available from Yuka Shell Epoxy K.K. (trade name: EPIKOTE 828) 85 parts Epoxy resin available from Ciba-Geigy AG. (trade name: DY022) 10 parts Epoxy type silane available from Shin-Etsu Chemical Co., Ltd. (trade name: KBM 403) 5 parts Curing Agent:

Microcapsule type curing agent available from Asahi Chemical Industry Co., Ltd (trade name: NOVACURE HX-3722) 60 parts (all by weight)

Then, the resin composition was cured at 80° C. in 2 hours.

To further form discharge openings, the cured material was polished until the tops of convex portions of the solid layer appeared. After the polishing, the product was immersed in acetone to dissolve away the resist.

In this way, the side shooter type ink jet head as shown in FIGS. 1A and 1B were produced. The face of discharge openings of the ink jet head thus produced was observed using an optical microscope to confirm that a highly reliable product was obtained which was free of defects such as cracks, break and scratches, free of residual resist and also free of peeling due to temperature changes.

Using an ink jet apparatus having the ink jet head thus prepared, printing was tested.

The printing was tested under conditions of a nozzle density of 360 DPI with 1,344 nozzles in number, and a discharge frequency of 2.84 kHz, using a water-based DEG 15% ink (containing 3% by weight of a dye). As a result, stable printing was performed.

EXAMPLE 2

A side shooter type ink jet head was produced in the same manner as in Example 1 except that the following was used as the curing agent of the curable resin.

FUJICURE 6010 (trade name; available from Fuji Chemical Co., Ltd.) 50 parts (by weight)

The face of discharge openings of the ink jet head thus produced was observed using an optical microscope to confirm that a highly reliable product was obtained which was free of defects such as cracks, break and scratches, free of residual resist and also free of peeling due to temperature changes.

Using an ink jet apparatus having the ink jet head thus prepared, printing was tested.

The printing was tested under conditions of a nozzle density of 360 DPI with 1,344 nozzles in number, and a discharge frequency of 2.84 kHz, using a water-based DEG 15% ink (containing 3% by weight of a dye). As a result, stable printing was performed.

As described above, according to the ink jet head production process of the present invention, the products can be obtained through simple steps, in a shorter time and through a smaller number of steps, and hence, the process has the effect of achieving a superior bulk productivity and also reducing the cost of products.

An instance where the process of forming the solid layer in the present invention is applied to an edge shooter type ink jet head will be described below.

In the case of the side shooter type ink jet head, the solid layer at the part where the liquid-flow path is formed and the solid layer at the part where the discharge opening is formed are integrally formed. In the case of the edge shooter type ink jet head, the solid layer at the part where the liquid-flow path is formed and the solid layer at the part where the liquid chamber is formed are integrally formed. The latter will be described below by giving Examples.

EXAMPLE 3

Figure 4:
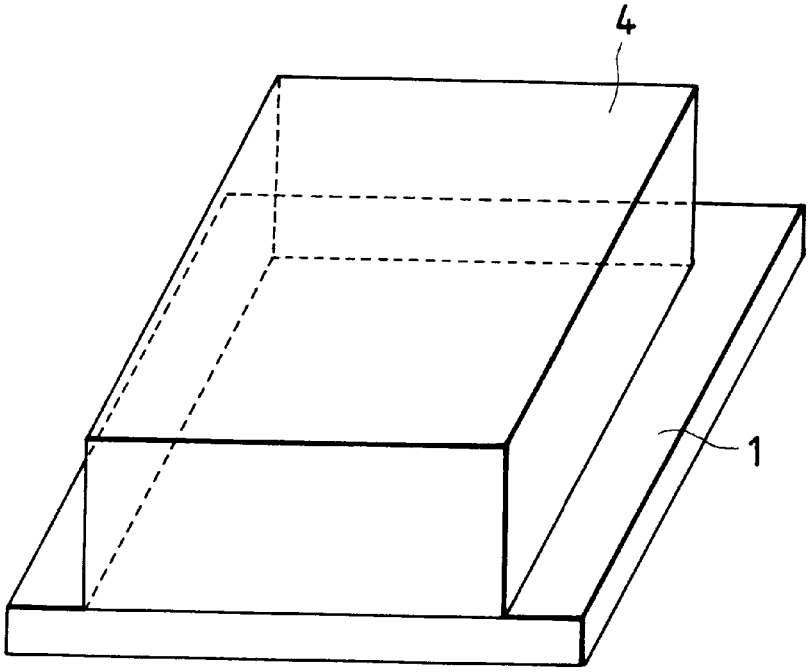
FIGS. 4 to 7 illustrate a process of producing an ink jet head in Examples 3 to 7 of the present invention.
Figure 5:
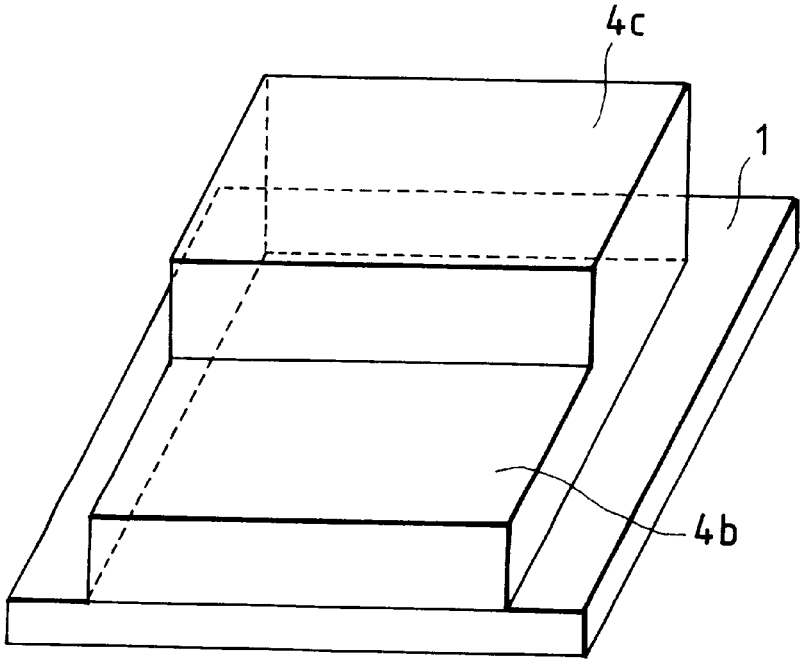

On a glass treated substrate 1 on which electrothermal transducers had been formed as liquid-discharge energy generating elements, a positive type photoresist AZ-4903 (trade name; available from Hoechst Japan Ltd.) was spin coated so as to be in a layer thickness of 50 $\mu$m, followed by pre-baking in an oven at 90° C. for 40 minutes to form a resist layer 4 (FIG. 4). To the surface of the resist layer 4 thus formed, patternwise exposure was applied at an exposure dose of 800 mJ/cm$^2$ using a mask aligner PLA-501 (trade name; available from Canon Inc.) via a mask pattern whose part corresponding to liquid chambers was light-screened, followed by development by the use of an aqueous solution of 0.75% by weight of sodium hydroxide. Then, the pattern formed was rinsed with ion-exchanged water, followed by post-baking in a vacuum oven at 50° C. for 30 minutes to obtain a resist pattern (FIG. 5) with a liquid-flow path forming part 4*b* developed by 25 $\mu$m in depth.

Figure 6:
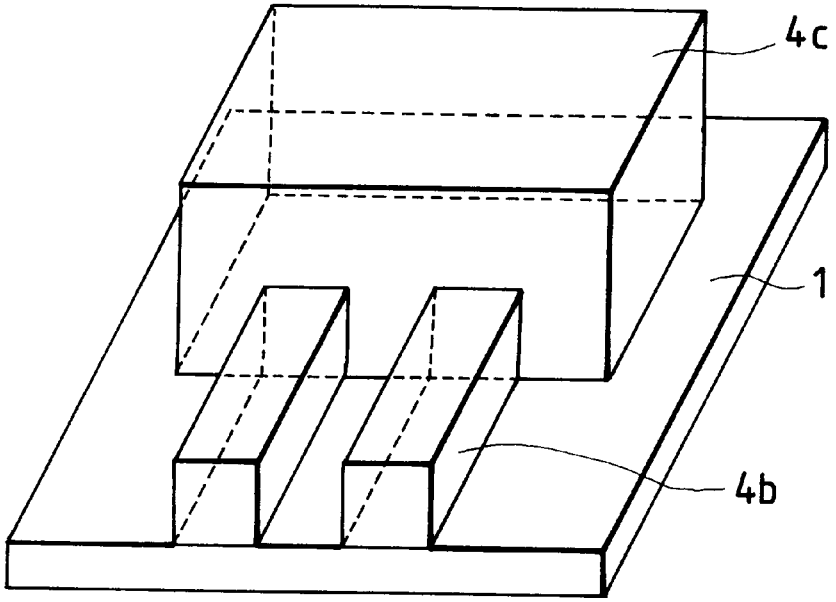

Next, with alignment on this resist pattern, patternwise exposure was again applied at an exposure dose of 800 mJ/cm$^2$ via a mask pattern whose part corresponding to liquid-flow paths and liquid chambers was light-screened, followed by development by the use of an aqueous solution of 0.75% by weight of sodium hydroxide. Then, the pattern formed was rinsed with ion-exchanged water, followed by post-baking at 70° C. for 30 minutes to obtain a resist pattern (FIG. 6). The resist pattern thus obtained was observed using an optical microscope, where the resist pattern was observed which was 25 $\mu$m high at its part of the liquid-flow path 4*b* and 50 $\mu$m high at its part of the liquid chamber 4*c*.

Next, this resist pattern was subjected to whole area exposure at an exposure dose of 800 mJ/cm$^2$, and further to deaeration for 30 minutes under vacuum condition of 0.1 mmHg. Thereafter, on the resist pattern, a photocurable material comprised of the following epoxy resins available from Union Carbide Japan K.K.:

CYRACURE UVR-6110 (trade name) 40 parts

CYRACURE UVR-6200 (trade name) 20 parts

Figure 7:
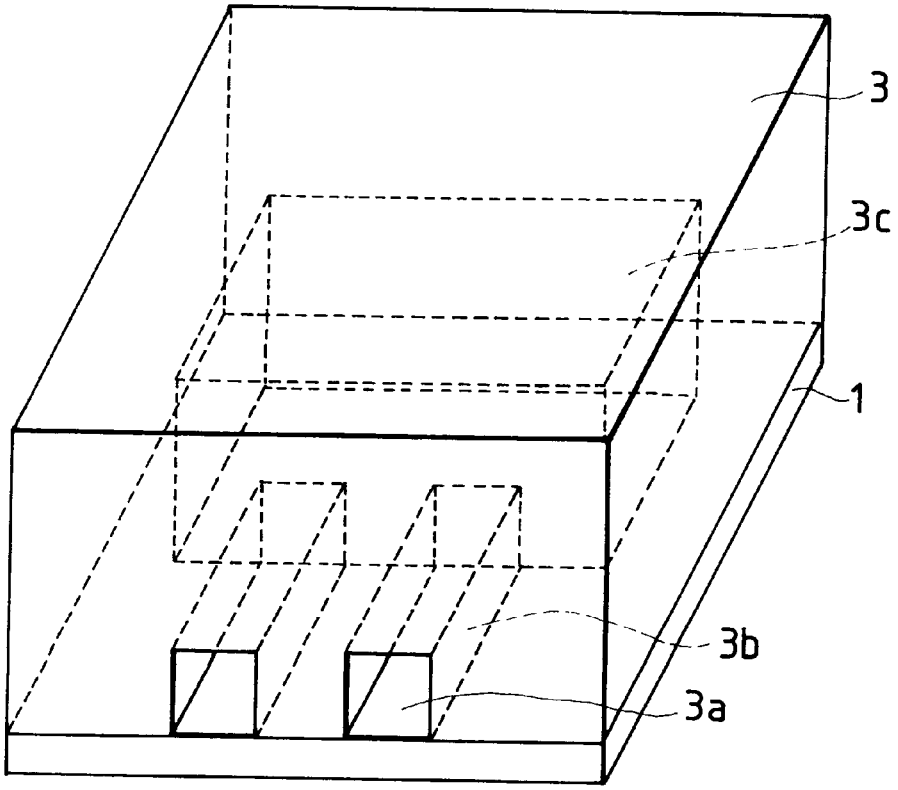
Figure 8A:
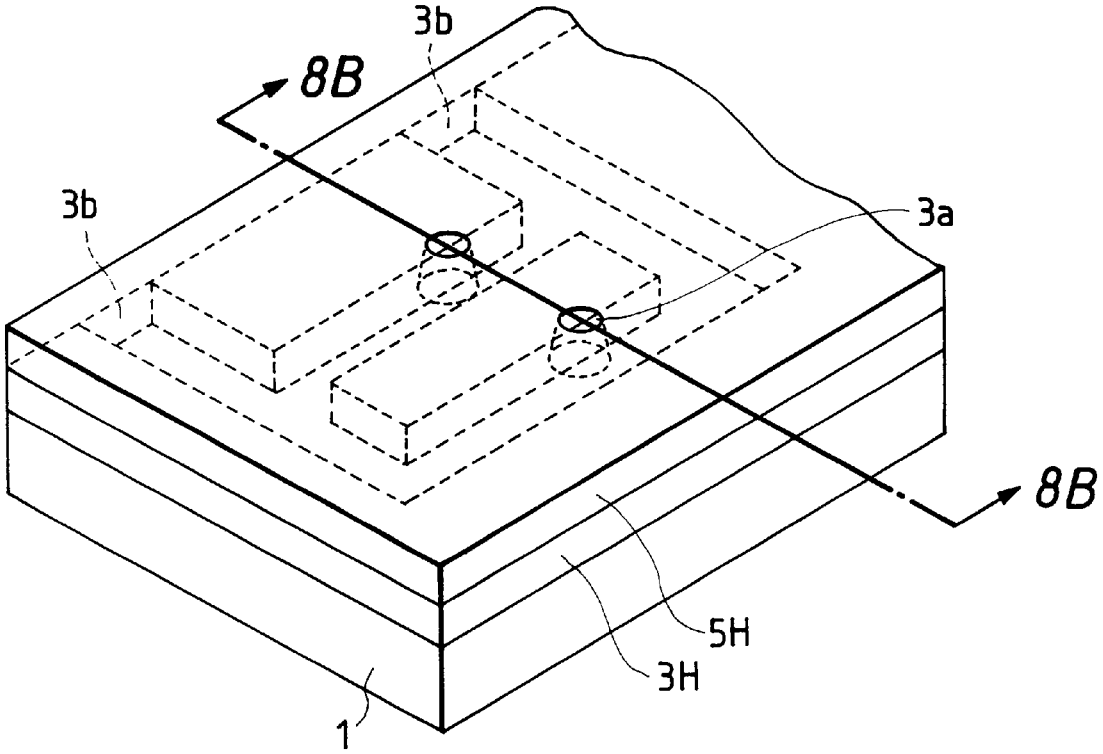
FIGS. 8A and 8B diagrammatically illustrate the construction of a conventional ink jet head.
Figure 8B:
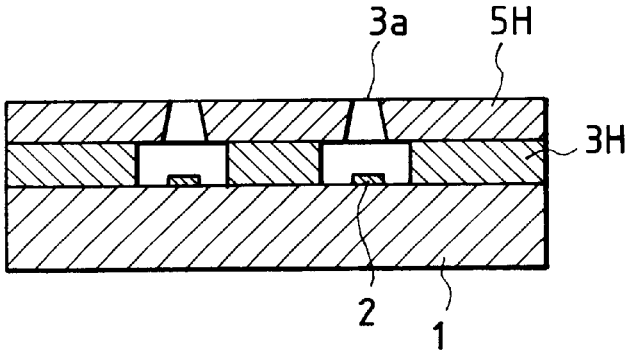

CYRACURE UVR-6351 (trade name) 40 parts (all by weight)

and the following curing agent:

Triphenylsulfonium hexafluoroantimonate 1 part (by weight)

was coated, followed by whole area exposure at an exposure dose of 8.5 J/cm$^2$ to cause the coating to cure. Subsequently, the substrate thus treated was immersed in an aqueous solution of 3.0% by weight of sodium hydroxide to dissolve away the resist pattern (FIG. 7).

Nozzles thus prepared were those having a very high precision and a high reliability. Also, the ink jet head thus produced enabled stable printing.

EXAMPLE 4

On a glass treated substrate on which electrothermal transducers had been formed as liquid-discharge energy generating elements, a positive type photoresist PMER-PG7900 (trade name; available from Tokyo Ohka Kogyo Co., Ltd.) was spin coated so as to be in a layer thickness of 50 μm, followed by pre-baking in an oven at 90° C. for 40 minutes to form a resist layer. To the surface of the resist layer thus formed, patternwise exposure was applied at an exposure dose of 900 mJ/cm$^2$ using a mask aligner PLA-501 (trade name; available from Canon Inc.) via a mask pattern whose part corresponding to liquid chambers was light-screened, followed by development by the use of an aqueous solution of 1.25% by weight of sodium hydroxide. Then, the pattern formed was rinsed with ion-exchanged water, followed by post-baking in a vacuum oven at 50° C. for 30 minutes to obtain a resist pattern with a liquid-flow path forming part developed by 25 μm in depth.

Next, with alignment on this resist pattern, patternwise exposure was again applied at an exposure dose of 900 mJ/cm$^2$ via a mask pattern whose part corresponding to liquid-flow paths and liquid chambers was light-screened, followed by development by the use of an aqueous solution of 1.25% by weight of sodium hydroxide. Then, the pattern formed was rinsed with ion-exchanged water, followed by post-baking at 70° C. for 30 minutes to obtain a resist pattern. The resist pattern thus obtained was observed using an optical microscope, where the resist pattern was observed which was 25 μm high at its part of the liquid-flow path and 50 μm high at its part of the liquid chamber.

Next, this resist pattern was subjected to whole area exposure at an exposure dose of 1.0J/cm$^2$, and further to deaeration for 30 minutes under vacuum condition of 0.1 mmHg. Thereafter, on the resist pattern, a photocurable material comprised of the following epoxy resins available from Union Carbide
Japan K.K.:
CYRACURE UVR-6110 (trade name) 40 parts
CYRACURE UVR-6200 (trade name) 20 parts
CYRACURE UVR-6351 (trade name) 40 parts (all by weight)
and the following curing agent:
Triphenylsulfonium hexafluoroantimonate 1 part (by weight)
was coated, followed by whole area exposure at an exposure dose of 8.5 J/cm$^2$ to cause the coating to cure. Subsequently, the substrate thus treated was immersed in an aqueous solution of 3.0% by weight of sodium hydroxide to dissolve away the resist pattern.

Nozzles thus prepared were those having a very high precision and a high reliability. Also, the ink jet head thus produced enabled stable printing.

EXAMPLE 5

On a glass treated substrate on which electrothermal transducers had been formed as liquid-discharge energy generating elements, a positive type photoresist AZ-4903 (trade name; available from Hoechst Japan Ltd.) was spin coated so as to be in a layer thickness of 50 μm, followed by pre-baking in an oven at 90° C. for 40 minutes to form a resist layer. To the surface of the resist layer thus formed, patternwise exposure was applied at an exposure dose of 800 mJ/cm$^2$ using a mask aligner PLA-501 (trade name; available from Canon Inc.) via a mask pattern whose part corresponding to liquid chambers was light-screened, followed by development by the use of an aqueous solution of 0.75% by weight of sodium hydroxide. Then, the pattern formed was rinsed with ion-exchanged water, followed by post-baking in a vacuum oven at 50° C. for 30 minutes to obtain a resist pattern with a liquid-flow path forming part developed by 25 μm in depth.

Next, with alignment on this resist pattern, patternwise exposure was again applied at an exposure dose of 800 mJ/cm$^2$ via a mask pattern whose part corresponding to liquid-flow paths and liquid chambers was light-screened, followed by development by the use of an aqueous solution of 0.75% by weight of sodium hydroxide. Then, the pattern formed was rinsed with ion-exchanged water, followed by post-baking at 70° C. for 30 minutes to obtain a resist pattern. The resist pattern thus obtained was observed using an optical microscope, where the resist pattern was observed which was 25 μm high at its part of the liquid-flow path and 50 μm high at its part of the liquid chamber.

Next, on the resist pattern, a heat-curable material comprised of an epoxy resin EME-700 (trade name), available from Sumitomo Bakelite Co., Ltd., was coated by transfer molding, followed by baking at 150° C. for 10 hours to cause the coating to cure. Subsequently, the substrate thus treated was immersed in an aqueous solution of 3.0% by weight of sodium hydroxide to dissolve away the resist pattern.

Nozzles thus prepared were those having a very high precision and a high reliability. Also, the ink jet head thus produced enabled stable printing.

EXAMPLE 6

On a glass treated substrate on which electrothermal transducers had been formed as liquid-discharge energy generating elements, a positive type photoresist PMER-PG7900 trade name; available from Tokyo Ohka Kogyo Co., Ltd.) was spin coated so as to be in a layer thickness of 50 μm, followed by pre-baking in an oven at 90° C. for 40 minutes to form a resist layer. To the surface of the resist layer thus formed, patternwise exposure was applied at an exposure dose of 900 mJ/cm$^2$ using a mask aligner PLA-501 (trade name; available from Canon Inc.) via a mask pattern whose part corresponding to liquid chambers was light-screened, followed by development by the use of an aqueous solution of 1.25% by weight of sodium hydroxide. Then, the pattern formed was rinsed with ion-exchanged water, followed by post-baking in a vacuum oven at 50° C. for 30 minutes to obtain a resist pattern with a liquid-flow path forming part developed by 25 μm in depth.

Next, with alignment on this resist pattern, patternwise exposure was again applied at an exposure dose of 900 mJ/cm$^2$ via a mask pattern whose part corresponding to liquid-flow paths and liquid chambers was light-screened, followed by development by the use of an aqueous solution of 1.25% by weight of sodium hydroxide. Then, the pattern formed was rinsed with ion-exchanged water, followed by post-baking at 70° C. for 30 minutes to obtain a resist pattern. The resist pattern thus obtained was observed using an optical microscope, where the resist pattern was observed which was 25 μm high at its part of the liquid-flow path and 50 μm high at its part of the liquid chamber.

Next, on the resist pattern, a heat-curable material comprised of an epoxy resin EME-700 (trade name), available from Sumitomo Bakelite Co., Ltd., was coated by transfer molding, followed by baking at 150° C. for 10 hours to cause the coating to cure. Subsequently, the substrate thus treated was immersed in an aqueous solution of 3.0% by weight of sodium hydroxide to dissolve away the resist pattern.

Nozzles thus prepared were those having a very high precision and a high reliability. Also, the ink jet head thus produced enabled stable printing.

What is claimed is:

1. A process for producing an ink jet head comprising a liquid-discharge energy generating element for discharging a liquid, a discharge opening provided above the liquid-discharge energy generating element and from which the liquid is discharged, a liquid-flow path communicating with the discharge opening and inside provided with the liquid-discharge energy generating element, and a substrate for holding the liquid-discharge energy generating element, the process comprising the steps of:

preparing the substrate;

providing on the substrate the liquid-discharge energy generating element;

providing a solid layer on the surface of the substrate where the liquid-discharge energy generating element has been provided and at the part where the liquid-flow path and the discharge opening are to be provided, the solid layer partly having a convex portion, the convex portion being provided corresponding to the liquid-discharge energy generating element, the solid layer being formed of a resin capable of being dissolved away;

applying on the substrate provided with the solid layer a curable material in a thickness larger than the thickness of the solid layer, to cover the solid layer;

curing the curable material;

evenly removing the cured material until the convex portion of the solid layer is laid bare; and dissolving away the solid layer to form the liquid-flow path and the discharge opening.

2. The process for producing an ink jet head according to claim 1, wherein the solid layer is formed by subjecting a positive type resist to exposure and development each twice, and the second-time exposure pattern is within the area of the first-time exposure pattern and is different from the first-time exposure pattern.

3. The process for producing an ink jet head according to claim 1, wherein the curable material is an active energy radiation curing type material.

4. The process for producing an ink jet head according to claim 1, wherein the curable material is a heat-curing type material.

5. The process for producing an ink jet head according to claim 2, wherein the positive type resist is developed using an aqueous alkali solution.

6. The process for producing an ink jet head according to claim 2, wherein the positive type resist contains a naphthoquinone diazide derivative.

* * * * *